United States Patent [19]

Bell

[11] 4,272,852

[45] Jun. 16, 1981

[54] GARMENT WITH SHOULDER ATTACHED SUPPORTING STRAPS

[75] Inventor: Richard S. Bell, Gloucester, Mass.

[73] Assignee: Mighty-Mac, Inc., Gloucester, Mass.

[21] Appl. No.: 901,308

[22] Filed: Apr. 28, 1978

[51] Int. Cl.[3] ..... A41D 1/00; A45C 1/04

[52] U.S. Cl. ..... 2/94; 224/182; 224/257

[58] Field of Search ..... 2/94, 305, 304, 93, 2/321, 88, 89; 224/5 K, 5 N, 5 R, 8 R, 5 BC, 5 P, 11

[56] References Cited

U.S. PATENT DOCUMENTS

| | | | |
|---|---|---|---|
| 939,871 | 11/1909 | Sherman | 2/94 |
| 1,207,154 | 12/1916 | Fox | 224/5 N |
| 1,340,077 | 5/1920 | Orr | 2/94 |
| 1,444,750 | 2/1932 | Moore | 2/94 |
| 2,018,606 | 10/1935 | Cumings | 224/11 |
| 2,970,316 | 2/1961 | Silin | 2/94 |
| 3,848,267 | 11/1974 | DeSpain | 224/5 K |

OTHER PUBLICATIONS

U.S. News and World Report, Apr. 10, 1978, p. 57.
Advertising Brochure La Sport Inc., Apr. 21, 1978.

*Primary Examiner*—Doris L. Troutman
*Attorney, Agent, or Firm*—Harvey B. Jacobson

[57] ABSTRACT

An outer garment having means affixed to the shoulders for removably securing a knapsack at either the front, the rear, or knapsacks at both the front and rear of the garment is disclosed. A pair of shoulder straps, each extending over one of the shoulders of the garment from the front to the rear, has free ends adapted to secure and remove the knapsack or knapsacks, the securing means comprising a loop connecting the strap to a ring. The knapsack is equipped with a pair of hook-type snap fasteners, such as a snap hook, arrnaged on the knapsack to permit attaching to the rings at the ends of the shoulder straps on the front of the garment, or the rings at the end of the shoulder straps at the rear of the garment. Alternatively, two knapsacks so equipped can be so attached, one at the front and one at the rear.

8 Claims, 5 Drawing Figures

GARMENT WITH SHOULDER ATTACHED SUPPORTING STRAPS

BACKGROUND OF THE INVENTION

1. Field of the Invention

The invention relates to an outer garment, such as a jacekt or coat, the garment having a pair of shoulder straps permanently affixed to the outside of the garment and extending from the front to the rear. The arrangement of parts and details of construction provide a decorative as well as functional garment.

2. Description of the Prior Art

Outer garments with shoulder straps for supporting accessories or attachments are known. Silin, in U.S. Pat. No. 2,970,316, shows a removable school bag supportable at the back of a jacket by shoulder straps attached to the jacket. Sherman, in U.S. Pat. No. 939,871, discloses a coat supporting a pocket attachment by means of straps passing over the shoulders of the coat and securing the attachment wrapped around the wearer, the attachments passing over the shoulders of the garment and securing the attachment at both the front and rear. Kirschenbaum, in U.S. Pat. No. 2,304,574, shows a knapsack jacket with the knapsack built into the back of the jacekt.

Other patents showing the state of the prior art are the following:

U.S. Pat. Nos. 1,426,024, Aug. 15, 1922, Thureson; 1,839,143, Dec. 29, 1931, Ellis; 2,652,567, Sept. 22, 1953, Fisher; 3,682,358, Aug. 8, 1972, Richey.

All these garments fail to provide a garment for conveniently attaching and removing a knapsack by means of a permanently attached shoulder strap. Furthermore, many of the garments shown in the prior art lack decorative appeal, or they fail to allow for comfortable support of a detachable knapsack. In addition, none of the prior art references cited above provides for a knapsack attachable and detachable either on the back, front, or both the back and front of a garment, thereby obviating the convenience obtainable from such an arrangement.

SUMMARY OF THE INVENTION

The present invention is constructed to fill the need for an outer garment to be used in combination with a knapsack conveniently attachable and removable from either the front or back of the garment. The invention provides decorative, as well as functional, permanently attached shoulder straps, and separate knapsacks that can be attached at both the front and back, or a single knapsack attached at either the front or back.

Accordingly, it is an object of the present invention to provide an outer garment having attaching means for supporting a removably attachable knapsack at either the front or the rear of the garment.

Another object of the invention is to provide an outer garment with permanently affixed shoulder supporting straps as attaching means for supporting a removably attachable knapsack at either the front or the rear of the garment.

Still another object of the invention is to provide an outer garment with attaching means for supporting two removably attachable knapsacks at both the front and back of the garment.

Yet another object of the invention is to provide securing means for conveniently attaching the knapsacks to the supporting straps.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
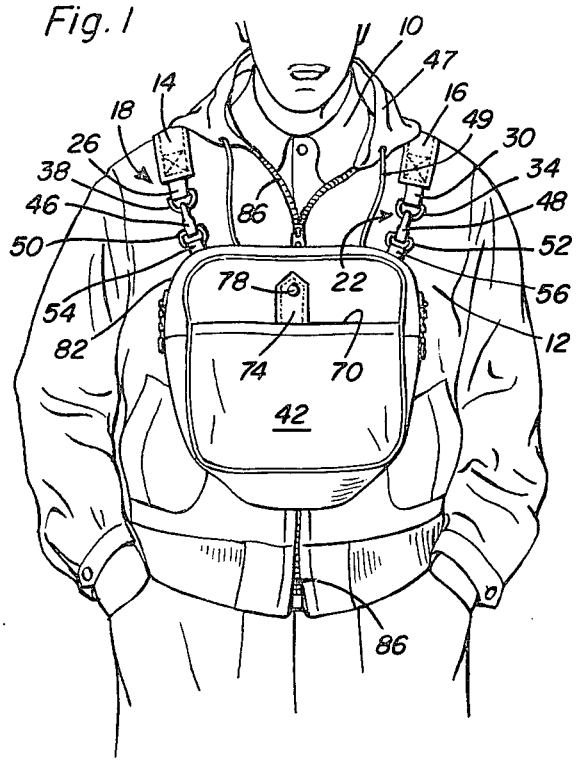
FIG. 1 is a front elevational view of the outer garment of the present invention in use when worn by a wearer, with an attached knapsack at the front.
Figure 2:
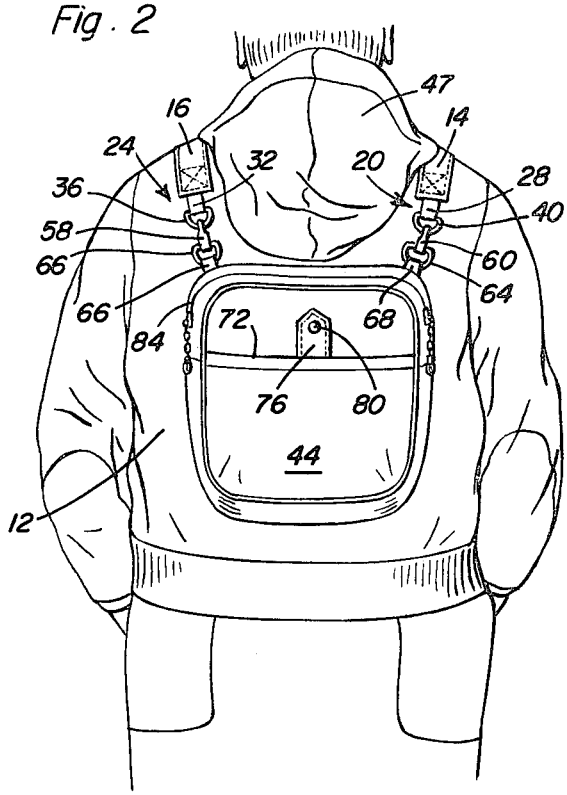
FIG. 2 is a rear elevational view of the garment of the present invention in use when worn by a wearer, with an attached knapsack at the rear of the garment.
Figure 3:
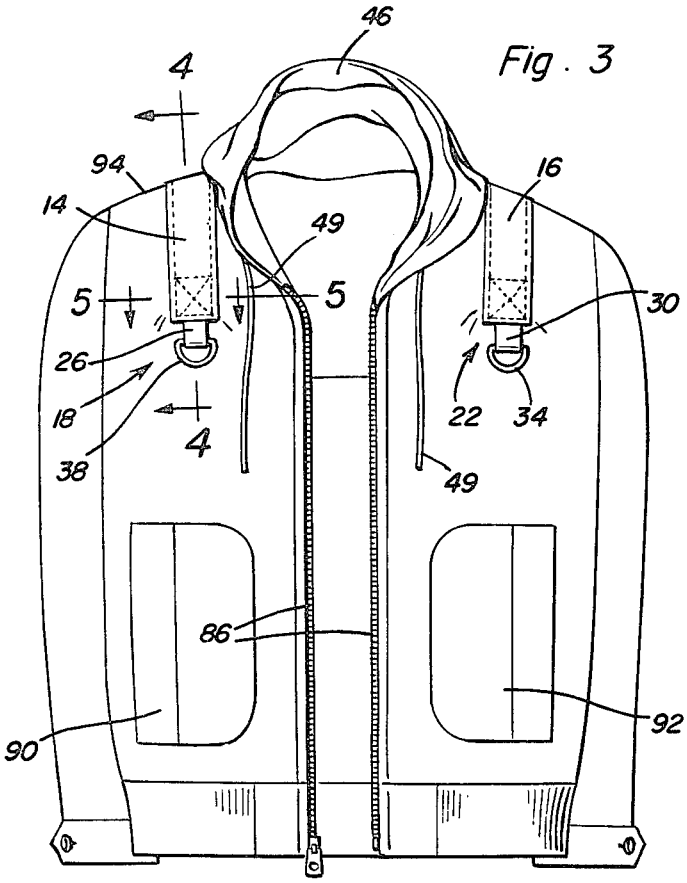
FIG. 3 is a front elevational view of the garment of the present invention without an attached knapsack.
Figure 4:
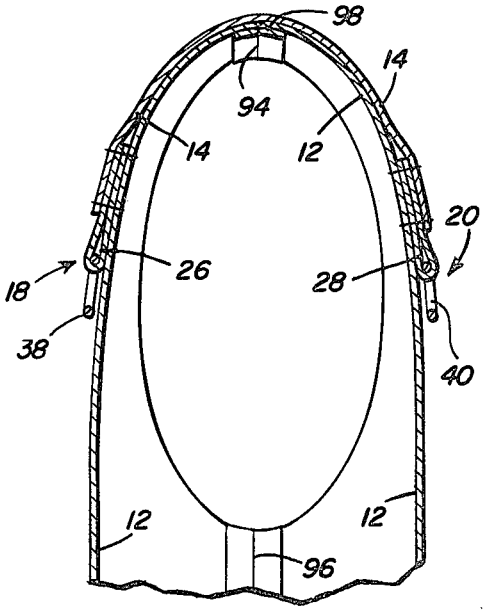
FIG. 4 is a fragmentary, vertical sectional view taken substantially upon a plane passing along section line 4—4 of FIG. 3, showing details of construction of the permanently affixed shoulder strap.
Figure 5:
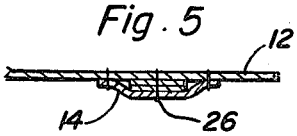
FIG. 5 is a fragmentary, enlarged, top sectional view taken substantially upon a plane passing along section line 5—5 of FIG. 3, showing details of the manner of attachment of the shoulder strap to the garment of the present invention.

In FIGS. 1 and 2, wearer 10 is shown wearing garment 12 with right shoulder strap 14 and left shoulder strap 16 permanently attached to garment 12. Shoulder strap 14 has free end 18 at the front, and free end 20 at the rear. Shoulder strap 16 has free end 22 at the front and free end 24 at the rear. Cloth loops 26, 28, 30 and 32 are respectively affixed permanently to free ends 18, 20, 22 and 24 of shoulder straps 14 and 16. Each of the four cloth loops as shown in FIGS. 1 to 5 is stitched or sewn at stitching 17 both to shoulder straps 14 and 16, and to garment 12. Shoulder straps 14 and 16 are stitched or sewn at stiching 19 along substantially their entire length to garment 12. Each of the cloth loops 30, 32, 26 and 28 is looped around the straight portion of D-shaped rings 34, 36, 38 and 40, respectively. Each of the cloth loops and its associated D-shaped ring comprises a free end; for example, free end 18 of right shoulder strap 14 comprises cloth loop 26 and its associated D-shaped ring 38. Each free end of a shoulder strap represents a point of attachment for a removably attachable knapsack. FIG. 1 shows an attached front knapsack 42, and FIG. 2 shows shows an attached rear knapsack 44. As shown in FIGS. 1 and 2, straps 14 and 16 containing the respective free ends extend from the top of the shoulder area to an area just below the top of the chest at the front of the wearer and to the shoulder blade area at the back of the wearer. The free ends at the front and back are in substantial registration as shown in FIG. 4. The placement of free ends 18 and 22, and 20 and 24 allows knapsacks 42 and 44 to be positioned above the waist when attached, whereby knapsack 42 rests upon the chest of the wearer and knapsack 44 can be supported on the back of the wearer. In use, garment 12 is adapted to comfortably support knapsack 42 at the front, knapsack 44 at the rear, or both knapsacks 42 and 44. Although forming no part of the present invention, garment 12 as illustrated in FIGS. 1 and 2 includes hood 47 with draw strings 49 for tightening hood 47 about the head of the wearer during inclement weather.

As illustrated in FIGS. 1 to 4, hook-shaped snap fasteners are attached to the knapsacks carried upon outer garment 12, for attachment to the free ends 18, 20, 22 and 24 of shoulder straps 14 and 16. Although such an arrangement is preferred, it is also contemplated within the scope of the present invention to provide other forms of easily removable fastening mechanisms, and it is further contemplated to provide the free ends with the fastening mechanism. Such an arrangement with the fastening mechanism on the jacket is less preferred because when garment 12 is worn without a knapsack at either the front, the rear, or both locations, such unused fasteners would represent unutilized equipment free to generate distracting noises and free to snag on vegetation if, for example, garment 12 is used by a hunter. In the embodiment shown in FIGS. 1 and 2, hook-shaped fasteners 46 and 48 are attached to front knapsack 42 through respective D-shaped rings 50 and 52, which are attached to knapsack 42 through cloth loops 54 and 56, stitched or sewn to knapsack 42. Alternatively, knapsack 42 could be reversed, with fastener 46 attached to free end 22 of shoulder strap 16, and fastener 48 attached to free end 18 of should strap 14. Rear knapsack 44 is attached by means similar to that of front knapsack 42, with snap fasteners 58 and 60 respectively attached to free ends 24 and 20 of shoulder straps 16 and 14. Snaps 58 and 60 are attached to D-shaped rings 62 an 64, which are attached through cloth loops 66 and 68 to knapsack 44. Alternatively, knapsack 44 could be reversed, with snap 58 attached to free end 20, and snap 60 attached to free end 24.

Although forming no part of the present invention, knapsacks 42 and 44 are provided with pouches, respectively numbered 70 and 72, with tabs respectively numbered 74 and 76 adapted to close pouches 72 and 74 through fasteners respectively numbered 78 and 80. Access to the interior of knapsacks 42 and 44 is obtained through closure means, such as a zipper, respectively numbered 82 and 84. Also forming no part of the present invention but illustrated for convenience is garment closure means 86, which can be a zipper-type fastener. It is to be understood that garment 12 can take many forms of conventional construction and design, including jackets and coats made from light, medium and heavy weight materials, lined or unlined garments, waist length or longer garments, coats, jackets, sweaters, shirts, and other forms of outer garment. Garment 12 can contain pockets 90 and 92, or pockets can be absent. Alternative closure means, such as buttons, snaps, hooks, or other suitable closure means can be used instead of closure means 86, illustrated as a zipper-type closure. Garment 12 can be constructed of any conventional material or blend of materials, and can be waterproofed or made water resistent for outdoor use.

Many alternative removably attachable fastening means between free ends of shoulder straps 14 and 16 can be substituted for the arrangement shown in FIGS. 1 to 5. For example, connection can be made by tying with cord, by pressure-engaging metal snap fasteners, by roughened synthetic fiber surfaces constructed to removably adhere upon application of pressure, by a buttoning arrangement through a cloth slit, and by many alternatives and equivalents. The arrangement illustrated in the drawings is, however, the preferred mode of attachment.

The shoulder straps 14 and 16 of the present invention can be made of material of a different color from that of the outside surface of garment 12. Although a stitching pattern in the shape of a square and cross are shown at the ends of straps 14 and 16, other decorative stitching patterns can be used. Straps 14 and 16 can be printed with identifying trademarks, decorative patterns, personalized embellishments, and the like. For military use, straps 14 and 16 can be provided to receive insignia of rank. Garment 12 is most conveniently constructed by sewing along seam 94 passing from the neck toward the arm, and seam 96 beneath the arm portion of the jacket. Reinforcement 98 along the shoulder is also provided.

When loads of light weight or medium weight are carried, garment 12 is most easily utilized with a single knapsack 42 or 44 attached at either the front or rear, and will be attached at the front for convenience of access, or at the rear for convenience in opening of jacket 12 at closure 86, depending upon the preference of the user. For heavier weight loads, use of both knapsacks 42 and 44 provides for balance in carrying such heavier weights. If use is contemplated with variable weight loads, it is possible to fold one of the two knapsacks for storage and transporting in the other, so as to wear only one knapsack when transporting a light weight load, but to then attach both knapsacks for use in carrying heavier weights. This capability of adapting the garment of the present invention to varying requirements provides both comfort to the user, as well as safety from physical injury possible from carrying an unbalanced load, particularly for long periods of time, such as commonly is encountered during use by hunters, hikers, fishermen, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An outer garment having attaching means affixed to the outside thereof for removably securing an attachable knapsack at an outside location on the garment selectable from the front of said garment and the rear of said garment, the garment having front closure means and shoulders, said attaching means comprising a pair of shoulder straps extending over the respective shoulders of said garment from the front to the rear of said garment, said straps being sewn to the outside of said garment substantially along the entire length of said straps, each of said straps containing a free end, said free end comprising a cloth loop passing through a ring, said ring capable of removably securing said attachable knapsack, said cloth loop being affixed to said strap by stitching the length of said straps containing the respective free ends extending from the top of the shoulder area of said garment to an area of said garment just below the top of the chest at the front of the wearer and to the shoulder blade area at the back of the wearer, whereby the placement of the free ends at the front of the garment allows a knapsack to be positioned above the waist and supported against the chest of the wearer and the placement of the free ends at the rear of the garment allows a knapsack to be positioned above the waist and supported on the back of the wearer, the attaching means producing both a decorative and a functional effect.

2. The garment of claim 1 together with first and second attachable knapsacks attached to said rings at the front and rear of said garment so as to provide one of said knapsacks at the front of said garment and the other of said knapsacks at the rear of said garment 3. The garment of claim 1 wherein said loop comprises a flat cloth strip folded to form said loop and having ends stitched to said strap.

4. The garment of claim 3 wherein said attachable knapsacks are provided with a pair of attaching means spaced for attachment to said rings, each of said attaching means comprising a hook-shaped snap fastener pivotably connected with a D-ring connected by a loop to said knapsack.

5. The garment of claim 4 wherein each of said shoulder straps is decoratively embellished.

6. The garment of claim 1 wherein said garment is a jacket.

7. The garment of claim 6 wherein said jacket and said knapsacks are waterproofed.

8. The garment of claim 1 wherein each of said cloth loops are further sewn to said garment.

* * * * *